US005110313A

United States Patent [19]

Po

[11] Patent Number: 5,110,313

[45] Date of Patent: May 5, 1992

[54] SEPARABLE BLADE ASSEMBLY FOR RUBBER RAFT

[76] Inventor: Tsai J. Po, 191, Minchuan Rd., Tamshui Taipei, Taiwan

[21] Appl. No.: 411,657

[22] Filed: Sep. 25, 1989

[51] Int. Cl.[5] ..... B63H 1/04

[52] U.S. Cl. ..... 440/90; 416/204 R; 416/208; 440/26; 441/129

[58] Field of Search ..... 440/26, 27, 90; 416/142 R, 142 A, 142 B, 142 C, 204 R, 208; 403/340, 371, 346, 354, 382; 441/129

[56] References Cited

U.S. PATENT DOCUMENTS

| | | | |
|---|---|---|---|
| 47,137 | 4/1865 | Sutherland | 416/208 |
| 525.664 | 9/1894 | Muller | 416/204 |
| 626,304 | 6/1899 | Schultz | 440/26 |
| 2,139,630 | 12/1938 | Cary | 416/204 |
| 3,874,319 | 4/1975 | Martin et al. | 440/27 |
| 4,340,318 | 7/1982 | Bush et al. | 403/340 |
| 4,537,526 | 8/1985 | Hartl | 403/371 |
| 4,894,033 | 1/1990 | Chang | 440/27 |

*Primary Examiner*—Sherman Basinger
*Assistant Examiner*—Thomas J. Brahan

[57] ABSTRACT

A separable blade assembly for a rubber raft, which can be easily disassembled and conveniently carried, including two blade members, two rod members, and a bolt member. The two blade members can be associated to form a blade assembly and the two rod members can be inserted through central holes of the blade members and connected by the bolt member for driving the blade assembly. When mounted on a rubber raft, one can step on two pedals of the rod members to consequently rotate the blade assembly and move the raft forward.

2 Claims, 4 Drawing Sheets

SEPARABLE BLADE ASSEMBLY FOR RUBBER RAFT

BACKGROUND OF THE INVENTION

Coast dabbling has become one of the modern major leisure activities in summer. Among various floats, an inflatable rubber raft provided with a blade assembly is quite popular. The blade assembly of the rubber raft includes a bent rod connected to a blade member at its central portion; pedals are connected to the rod outboard from the blade member. The bent rod has an excessive length ad can not be carried easily. Moreover, the conventional blade member is detachable from the blade assembly and thereby is apt to be mislaid. Furthermore, the conventional pedal is formed by two associated cover members so that water tends to collect in a gap existing therebetween such that a bad smell is produced.

SUMMARY OF THE INVENTION

Therefore I have developed the separable crankshaft and blade assembly of the present invention to eliminate the aforesaid shortcomings.

Accordingly, the separable crankshaft and blade assembly of the present invention includes two blade members constituting a blade assembly and two shorter rod members forming a drive rod assembly. The crankshaft and blade assembly of the present invention can be easily assembled and disassembled. AFter being disassembled, the length of the assembly is only half of the original length for easy carrying. Moreover, an inward tapered groove is formed on the pedal, communicating with a central tunnel thereof whereby the rod member can be forced to enter the central tunnel from the tapered groove without detachment; therefore the drawback of stagnating water is eliminated.

The present invention can be best understood through the following description and drawings wherein:

DETAILED DESCRIPTION OF THE PREFERRED EMBODIMENTS

Figure 1:
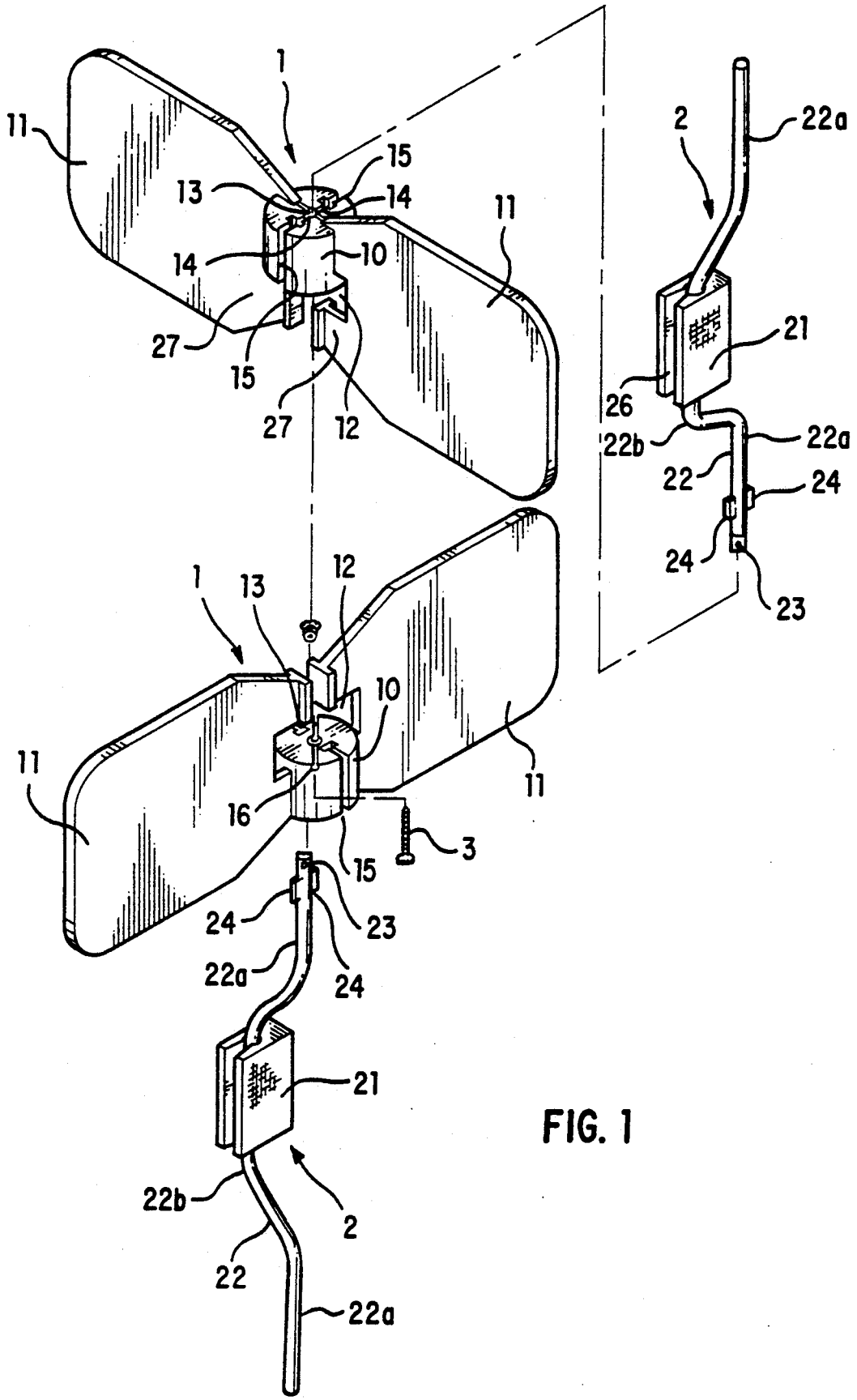
FIG. 1 is an exploded view of the present invention.

Please refer to FIG. 1. The crankshaft and blade assembly of the present invention primarily includes two blade components 1, two crankshaft components 2 and a fasteners bolt 3.

Figure 2:
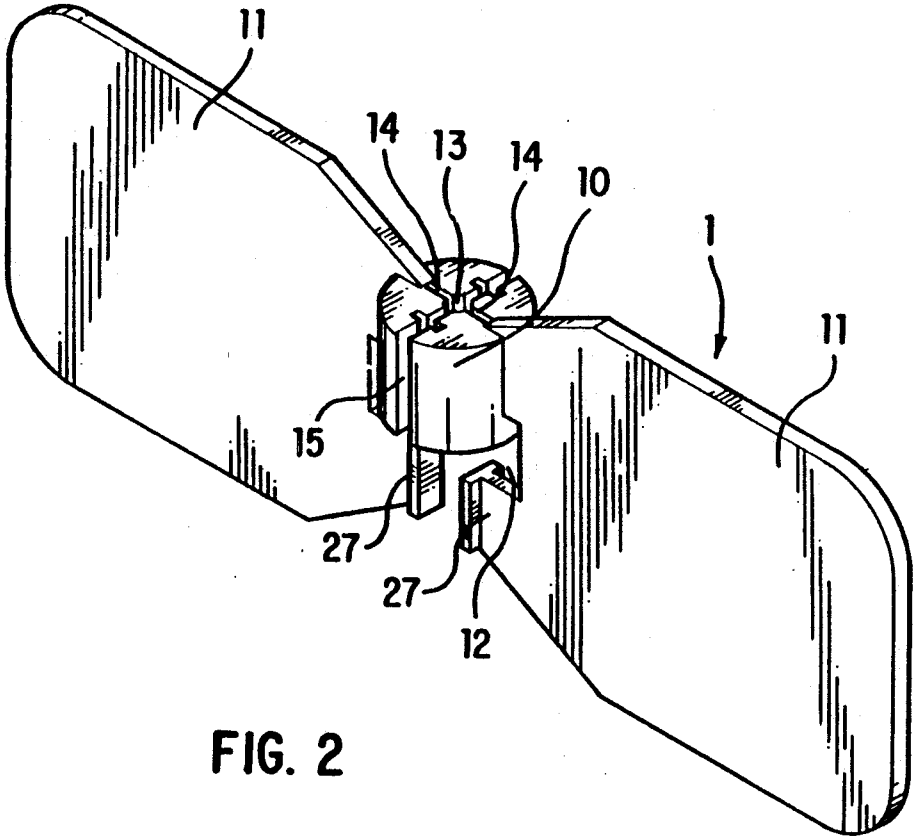
FIG. 2 is a perspective view of the blade member thereof.

As shown in FIg. 2, each of the blade components 1 includes two blades 11 and a central hub 10 connecting the two blades 11. Inner ends 27 of the two blades 11 are formed with two recesses 12 and two protrusion respectively. Each hub 10 is formed with a central through hole 13. The oppositely extending radial grooves 15 are formed on the hub 10 parallel to the central hole 13, said grooves extending in an axial plane normal to the plane of the blades 11. Four axial slots 14 are further formed on one end of each hub 10 at equal angles, and a small transverse diametrical hole 16 is extending through the hub 10 at its other end.

Figure 3:
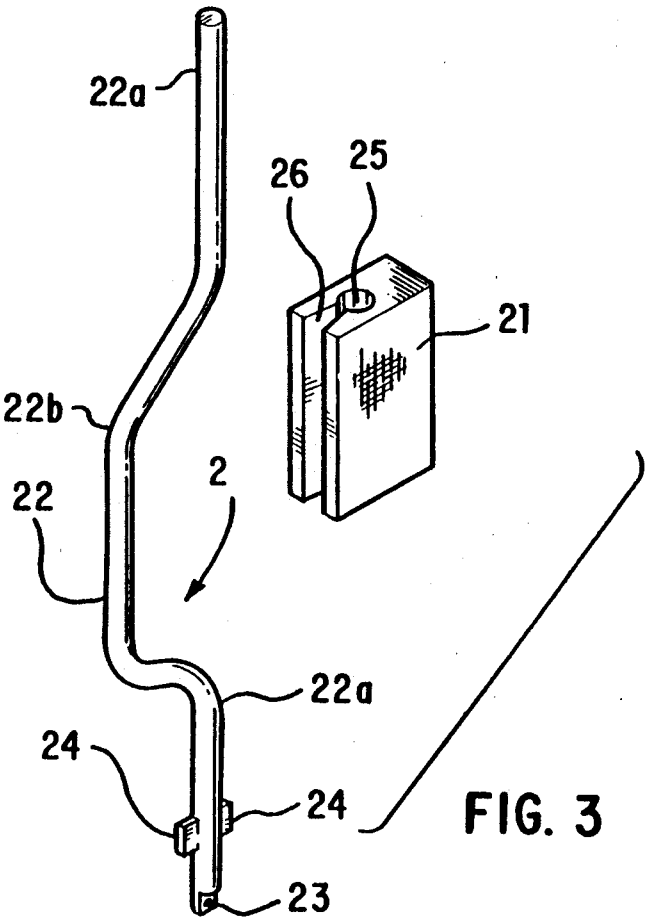
FIG. 3 is a perspective view of the rod member thereof.

As shown in FIG. 3, the crankshaft component 2 includes a shaped rod 22 having aligned portions **22*a* and a laterally offset crank portion 22*b*. A pedal 21 is connected to the rod 22. One end of the rod 22 is formed with transverse opening 23 and two flat keys 24 near the opening 23. The pedal 21 is integrally formed and has a central tunnel 25 and a segment shaped insert groove 26 which communicates with the central tunnel 25; the tunnel forms a circular bearing surface for engagement on crank portion 22*b*. The insert groove 26 has an outer width slightly larger than the diameter of the rod 22 and an inner width slightly smaller than the same, whereby the rod 22 is forced to enter the central tunnel 25 from the insert groove 26 without detachment from the central tunnel 25**.

Figure 4:
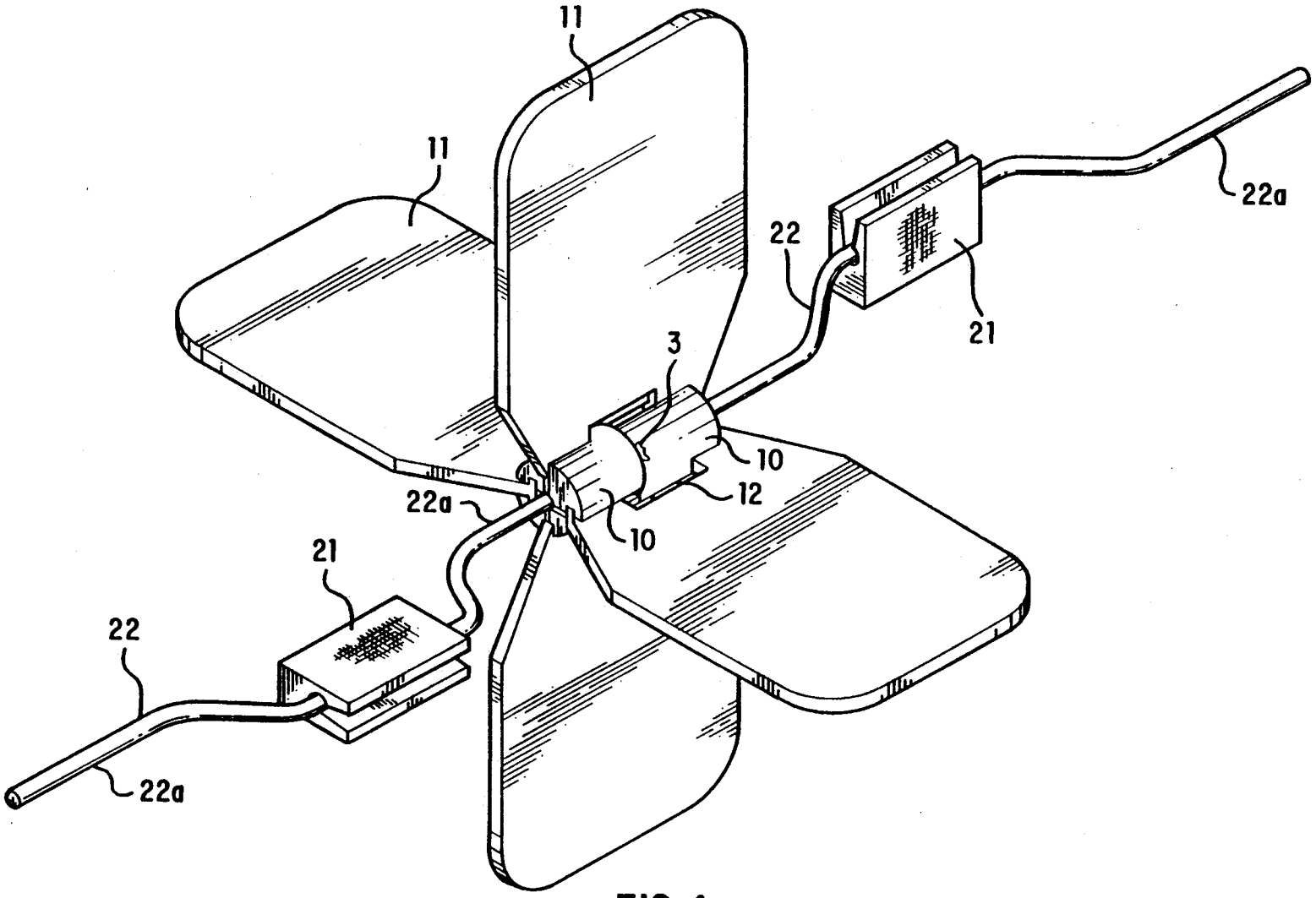
FIG. 4 is an assembled view of the present invention.

When assembled, the two blade components 1 are associated in such a manner that the protrusions on the inner ends of each set of blades 11 fit within grooves 15 of the other hub 10 to form a four blade assembly. The two crankshaft components 2 are respectively inserted through the axial holes 13 of the two aligned hubs 10 with their transverse openings 23 in registry with each other and with transverse hole 16 in one of the hubs. The bolt 3 is conducted through the aligned openings 23 and the small hole 16 of the hub 10 to secure the two rod members 22 together. The recesses 12 of the blades 11 permit the bolt 3 to be secured, and the keys 24 of the rod members 22 are fitted into the outer pairs of slots 14 of the blade members 1 whereby the crank portions **22*b* are ninety degrees out of phase, as shown in FIG. 4. The single fastener bolt 3 is effective to rigidly interconnect the two blade components 1 and the two rod members 22**.

Figure 5:
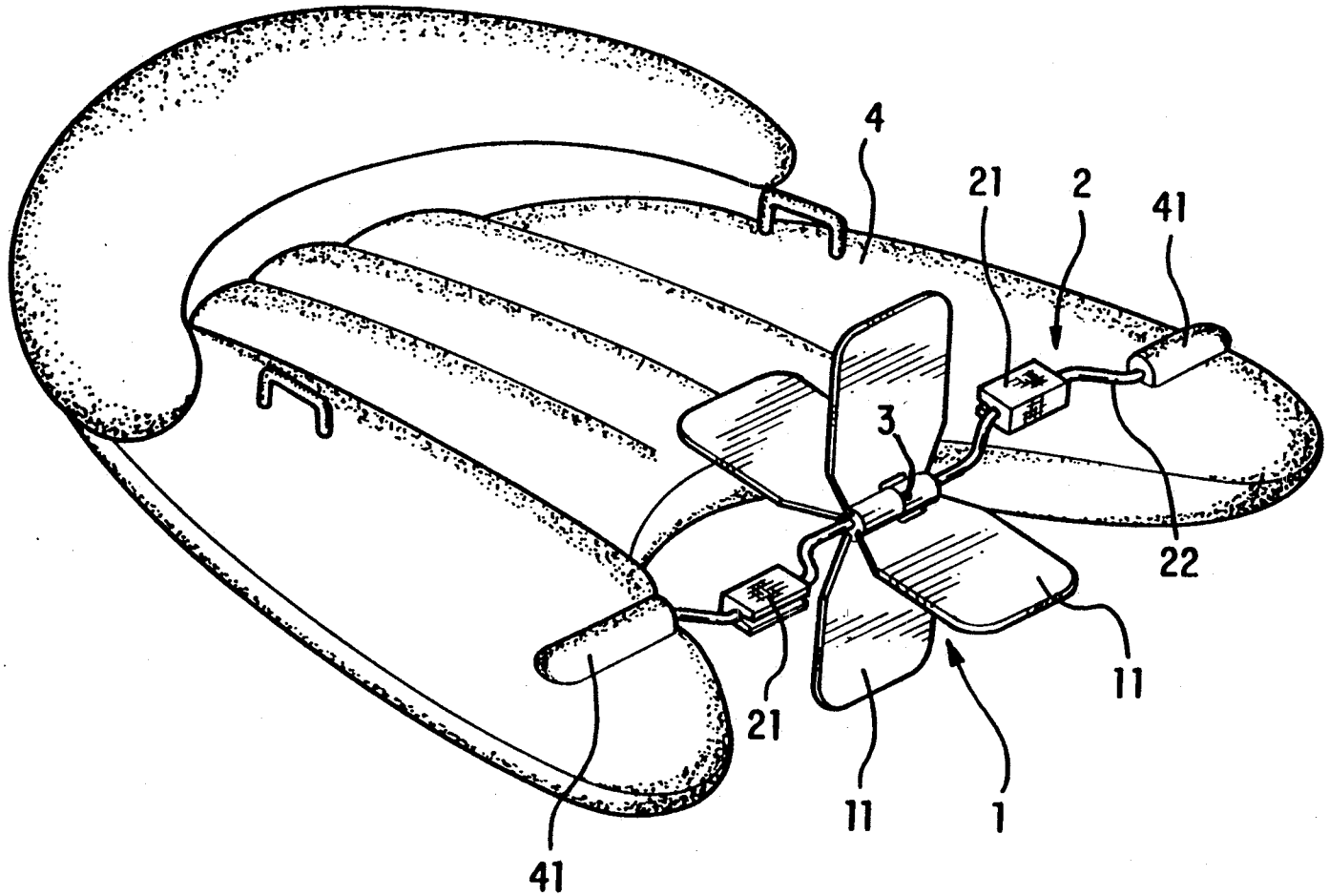
FIG. 5 shows the present invention mounted on a rubber raft when used.

Please refer to FIG. 5. The present invention is disposed on a rubber shaft 4 which has two supports 41 for mounting the two ends of the present invention thereon. One can step on the two pedals 21 with his two feet, enabling the rod members 2 to drive the blade members 1 and thereby move the rubber raft 4 forward.

The present invention possesses the following advantages: 1. It can be easily assembled or disassembled and can be conveniently carried or used. 2. The blades 11 and connector hub 10 thereof are integrally associated without possible detachment of the blades from the connector hub. 3. Each pedal 21 thereof is integrally formed without any gap apt to contain water, and thus a bad smell caused by stored water is avoided.

I claim:

1. A separable crankshaft blade assembly for use as a propulsion device on a rubber raft, said assembly comprising two interfitting blade components and two interfitting crankshaft components; each blade component comprising a central hub having a rotational axis, and two blade elements radiating outwardly from said hub in diametrically opposite directions; each said blade element having an axial length that is appreciably greater than the axial length of the associated hub to form a central free space in line with the hub, each said blade element having a free inner edge area thereof extending toward the hub central axis to a point within the central free space in line with said hub; each said hub having two axially extending grooves (15) extending in a plane normal to the plane of the associated blade elements; said hubs being axially engaged so that inner edge areas of the blade elements on one blade component fit within the axially extending grooves in the hub of the other blade component, thereby forming a four blade assembly wherein the blades are equidistantly spaced; each said hub having an axial hole (13) extending therethrough on the hub axis; one of said hubs having a transverse diametrical hole (16) extending therethrough in intersecting relation to the associated axial hole; each crankshaft component comprising a rod having two aligned end portions and an offset intermediate crank portion adapted to receive a pedal thereon; one end portion of each rod having a transverse opening (23) extending therethrough, and a key (24) extending from the rod surface near the transverse opening; each hub having an axial slot (14) radiating from the associated axial hole, each slot extending only part way along the axial dimension of the hub to interlockably receive one of said keys; said rods having end portions thereof insertable into the axial holes in the hubs so that the transverse openings (23) register with each other and with the transverse hole in said one hub; and a fastener (3) extending through said transverse hole and the registering openings to rigidly interconnect the two blade components and the two crankshaft components; said keys fitting into said axial slots so that the offset portion of one rod is ninety degrees out of phase with respect to the offset portion of the other rod.

2. The separable assembly of claim 1, and further comprising a foot pedal insertable onto the offset portion of each rod; each foot pedal having a circular bearing surface (25) fitting partially around the associated rod surface, and a segment-shaped groove (26) extending from said circular bearing surface to an outer surface of the pedal, whereby the pedal is insertable onto the rod by forcing the groove walls of the pedal to spread apart, to thus permit insertion of the rod into the space defined by the circular bearing surface.

* * * * *